US007533851B1

(12) United States Patent
Caplan

(10) Patent No.: US 7,533,851 B1
(45) Date of Patent: May 19, 2009

(54) FLEXIBLE KITE

(76) Inventor: Philip Caplan, 100 NE. 8th Ave., Apt. 313, Gainesville, FL (US) 32601

( * ) Notice: Subject to any disclaimer, the term of this patent is extended or adjusted under 35 U.S.C. 154(b) by 219 days.

(21) Appl. No.: 11/821,461

(22) Filed: Jun. 25, 2007

(51) Int. Cl.
*B64C 31/06* (2006.01)

(52) U.S. Cl. ..... 244/153 R

(58) Field of Classification Search ..... 244/153 R, 244/154, 155 R; D21/445
See application file for complete search history.

(56) References Cited

U.S. PATENT DOCUMENTS 701,106 A * 5/1902 Trainor ..... 244/155 R
2,588,293 A * 3/1952 Roe ..... 244/153 R
4,081,158 A 3/1978 Pearce
RE30,073 E * 8/1979 Worsham ..... 244/153 R

* cited by examiner

*Primary Examiner*—Michael R Mansen
*Assistant Examiner*—Michael Kreiner
(74) *Attorney, Agent, or Firm*—Sven W. Hanson

(57) ABSTRACT

A kite is formed of a single sheet of tough but flexible material. A narrow slit in the sheet body defines two distinct flight bodies, one of which is substantially smaller than the other. The smaller forward flight body is elongated and joins the larger flight body at the smaller portion's ends. The kite requires no rigid support structures and is capable of stable flight at very low wind speeds.

4 Claims, 2 Drawing Sheets

FLEXIBLE KITE

BACKGROUND OF THE INVENTION

The present invention pertains to recreational kites. In particular, the invention is a kite construction including a single sheet of flexible material that forms a flight body without rigid support members.

In prior kites, the effective shape of flexible flight surfaces are maintained by rigid members attached to the flight surfaces. This is typified by the very common diamond kite (with crossed rigid supports), box kites, and what is commonly known as "delta" configuration kites. All of these require their respective rigid members to resist air pressure forces and maintain the shape and orientation of the kite's flight surface.

SUMMARY OF THE INVENTION

The present invention is a kite formed of a single sheet of tough but flexible material. A long narrow slit in the sheet body defines two distinct flight bodies, one of which is substantially smaller than the other. The smaller forward flight body is elongated and joins the larger flight body at the smaller portion's ends. The slit includes two symmetric portions angled with respect to each other.

In use, a flight line is attached to a centered leading edge attachment point on the smaller of the flight bodies. When restrained by the flight line and exposed to wind, air pressure against a bottom surface of the flight bodies deformed the larger portion's bottom surface into a concave shape. The tension of the flight line deforms the smaller flight body downward, at the center, relative to the larger portion.

One aspect of the invention is a kite design that does not require rigid supports and has low weight thereby enabling operating at relatively low wind speeds.

Another aspect of the invention is a kite design without rigid supports and with flight surfaces that bend with changing wind forces to provide needed stability.

Another aspect of the invention is a kite design without rigid supports that may be rolled up, for storage or transport, when not in use.

Another aspect of the invention is a kite design that may be wider than long and is also stable in flight.

Additional novel aspects and benefits of the invention will be discerned from the following description of particular embodiments and the accompanying figures.

DETAILED DESCRIPTION OF THE INVENTION

Figure 1:
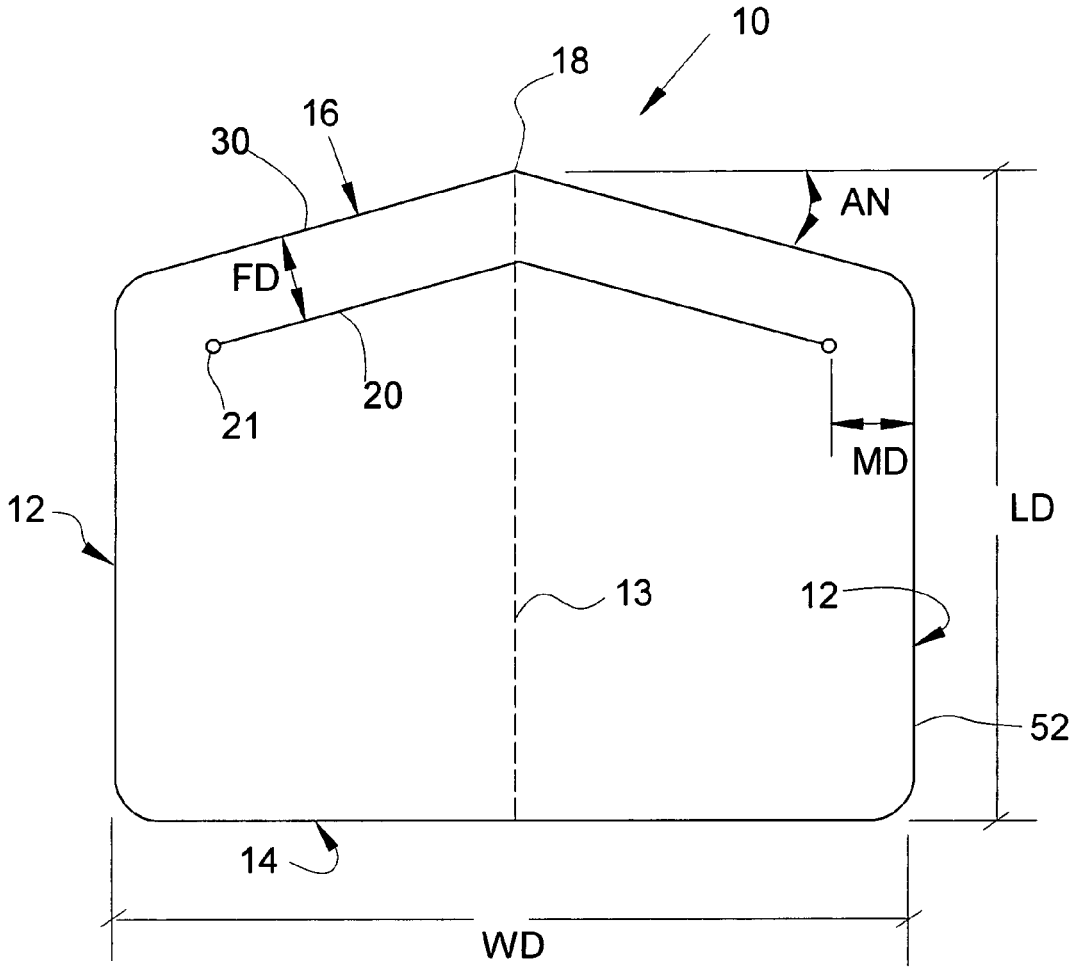
FIG. 1 is a plan view of a flat flexible sheet forming the inventive kite flight surfaces.
Figure 2:
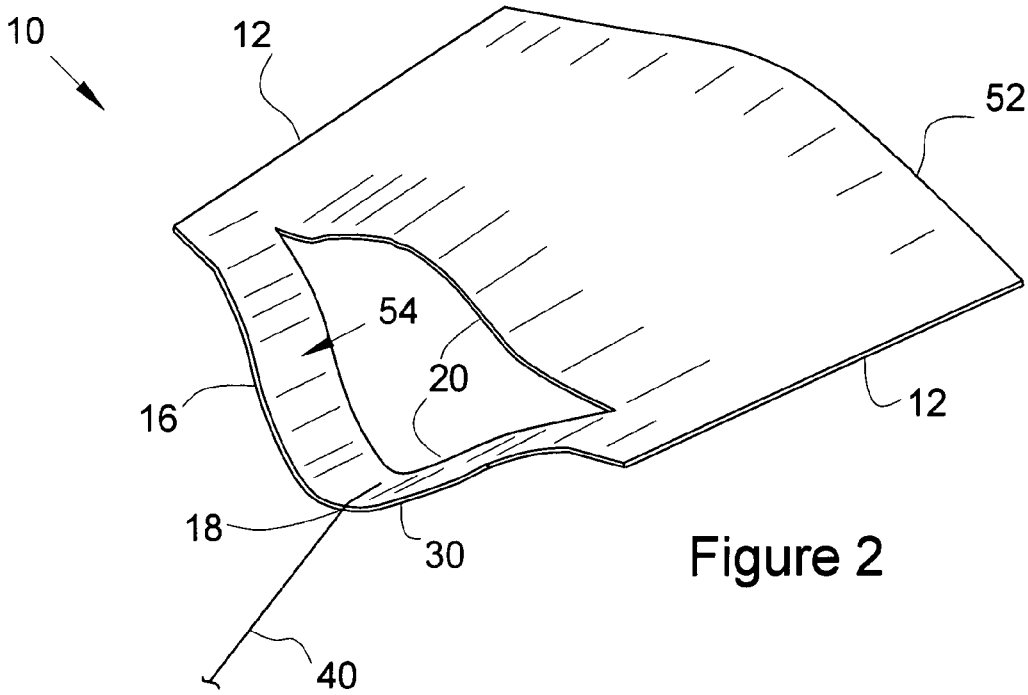
FIG. 2 is a perspective view of the inventive kite in flight.
Figure 3:
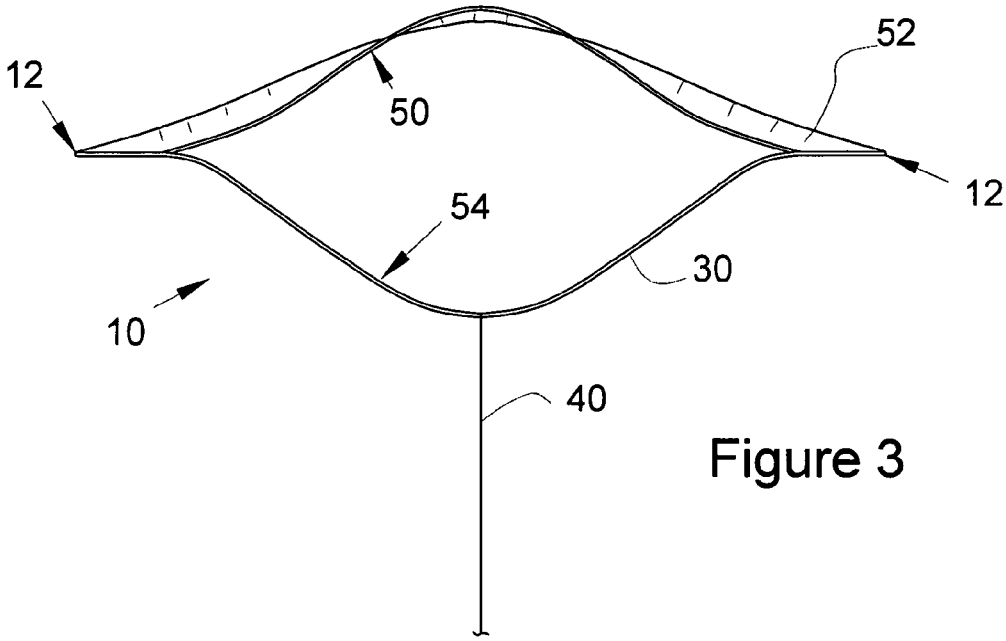
FIG. 3 is a front horizontal view of the embodiment of FIG. 2.

FIGS. 1, 2 and 3 depict a preferred embodiment of the invention. The following discussion regards all of the figures. The inventive kite body 10 is formed from a single sheet of flexible sheet material. The kite body 10 is preferably generally rectangular in shape with a width dimension WD between parallel opposing side edges 12. An aft edge 14 extends between the side edges 12. The kite body 10 has an overall length dimension LD, along a centerline of symmetry 13, and between the aft edge 14 and a forward-most peak 18 of a forward leading edge 16. The leading edge 16 includes two angled portions extending symmetrically rearward from the peak 18 to the side edges 12. The two leading edge angled portions each have an included angle AN relative to a transverse line perpendicular to the side edges 12. The angle AN has a dimension in the range of 20 to 40 degrees. Herein, the terms "leading", "forward", "aft" and similar terms are intended to indicate relative locations and positions, and are used with respect to the inventive kite's normal intended forward movement through the air when in use. The term transverse indicates an orientation perpendicular to the longitudinal orientation of the kite which, in operation is parallel to the incident wind direction.

Within the kite body 10 is a slit 20 offset a dimension FD from the leading edge 16. The slit 20 includes two angled portions and is symmetric in the same manner as the leading edge 16. The slit 20 is preferably parallel to the leading edge 16, but slight deviation (+/−5 degrees tolerance) from parallel is acceptable. Herein, deviation within this range, and like deviation, is considered substantially parallel. Herein, the term "slit" means a through-cut in the body, of zero width. A very narrow cut having minimal open width (less than a fraction of the offset dimension FD) will function equally and is therefore also considered a slit for purposes here. Note that the slit forms a second peak in the body behind the leading edge peak 18.

The slit 20 should terminate, at each end, a margin dimension MD from the adjacent side edge 12, measured perpendicular from the side edge. The margin dimension MD is preferably approximately equal the offset dimension FD. At each end of the slit 20, a small circular perforation 21 is preferably provided as a stress relief to inhibit tearing of the kite body 10. For the same purpose, local reinforcement, such as thickening of the kite body may also be used.

The slit 20 and the leading 16 define, between them, a forward portion forming an elongated kite wing 30 (with width FD), that extends, at a forward angle, generally between the side edges 12. At the peak 18 of the leading edge 16, the wing 30 is secured, in use, to a restraining string 40. The string 40 is preferably adhesively taped, or secured in similar manner, to the upper surface of the wing 30 such that the string extends smoothly forward from the leading edge 16 at the peak 18. This attachment geometry assists in properly forming the wing 30 and leading edge 16 with respect to the moving air during use. The peak 18 may be rounded, rather than sharply pointed as shown, to add to stability. As shown in FIG. 1, all corners of sides and edges may be similarly rounded.

The wing 30 is an effective "flight body" in that it is capable of producing reaction forces at nonzero angles to the direction of air flow over it. This capacity is a function of the geometry of the wing and attitude of the geometry in use; these relationships are well known. Bodies such as round rigid spars, tension members and strings are not considered flight bodies as they can produce only drag forces, parallel to the direction of impinging air flow.

At rest, without air impinging the kite, the kite body 10 is flat as shown in FIG. 1. During flight, air pressure against the kite bottom surface 50 flexes the kite into the shape shown in FIGS. 2 and 3. The wing 30 and rear portion 52 are vertically pushed apart and separated at the slit 20. The rear portion 52 of the kite (aft of the slit 20) flexes upward in the middle. The bottom surface 50 forms a generally concave shape. The wing 30 is drawn upward at the edge sides 12 and relatively downward at the peak by the attached string 40. The wing upper surface 54 forms a generally concave shape at the middle. The restraint of the margin at the side edges 12 flexes the wing 30 adjacent the side edges 12 into a more horizontal flight surface. This combined complex curve of the wing 30 provides stability to the kite body 10 in flight.

The geometry of the inventive kite provides a kite that will elevate and fly with stability in much lower wind speeds than most conventional kites. Flight attitude is at a lower than conventional angle of incidence with respect to the wind. This characteristics, in addition to the unobstructed nature of the rear portion 52 provides an ideal vehicle for graphical advertisements and the like.

To ensure stability, the area of the wing 30 should be a small fraction of the kite area. For this reason, offset dimension FD (the effective wing width) is preferably no more than 20 percent of the length dimension LD. Stability is also provided by the variability of the kite geometry. Variations in wind speed alter the shape of the kite portions as the air pressure flexes the kite, such that at higher wind speeds the side edges 12 are drawn together to reduce the effective width of the kite, thereby increasing inherent stability.

To provide the best shape of the leading edge wing 30, the margin dimension MD should be greater than 50 percent, and preferably 100 percent, of width of the wing (offset dimension FD). Bending of the sheet in the margin between the slit 20 and the side edges 12 defines the shape of the wing 30 near the side edges. As well, if the margin dimension MD is too small, the slit 20 is at risk of tearing out.

The kite body aspect ratio—length dimension LD to width dimension WD—is preferably less than one, with a ratio of 3:5 most preferred. Aspect ratios somewhat greater than 1:1 may work, but with reduced stability. At ratios greater than 1:1, the angle AN must be increased to provide an acceptable angle of incidence and flight attitude.

The kite body may be formed from a variety of flexible sheet materials sharing the characteristics of low weight density and moderate toughness. Heavy weight paper may be used for small kites if used in only low wind speeds. Newsprint, conventional writing paper, "kraft" paper and other sheet materials of similar high flexibility are too flexible for use except for miniature kites of a few inches in width. High density sheet polyethylene is an acceptable material for larger kites. A plastic closed cell foam sheet was found to have a good flexibility and weight.

The preceding discussion is provided for example only. Other variations of the claimed inventive concepts will be obvious to those skilled in the art. For example, the side edges 12 may deviate slightly from parallel or may be slightly curved while maintaining the essential characteristics and nature of the invention. Adaptation or incorporation of known alternative devices and materials, present and future is also contemplated. The intended scope of the invention is defined by the following claims.

The invention claimed is:

1. A kite comprising:

a single flexible sheet having:

a top and bottom surface, a longitudinal centerline having a length dimension;

opposing side edges, located symmetrically about the centerline, and a forward leading edge having two angled portions extending symmetrically rearward from a leading edge peak to the side edges;

a slit within the sheet, the slit parallel to the leading edge portions and offset behind the leading edge an offset dimension, the slit and the leading edge defining between them an elongated forward sheet portion, the forward portion separated from a rear sheet portion by the slit;

the slit having terminal ends, each end located separated from a respective adjacent sheet side edge by a transverse margin dimension, the margin dimension equal to at least 50 percent of the offset dimension;

the offset dimension being no more that 20 percent of the overall length dimension; and means of securing a string to the forward sheet portion;

such that when the sheet is restrained by a string secured to the forward sheet portion between the peak and slit, and an air current impinges against the bottom surface of the sheet, the rear portion will separate from the forward portion along the slit and flex upward to form a generally concave bottom surface and the forward portion will flex relatively downward to form a leading edge wing.

2. A kite, according to claim 1, and wherein:

the sheet has a transverse width dimension between the side edges greater than the length dimension.

3. A kite, according to claim 1, and wherein:

the portions of the leading edge each have an included angle dimension in the range of 20 to 40 degrees with respect to a transverse line.

4. A kite, according to claim 3, and wherein:

the sheet comprises a closed cell foam material.

* * * * *